US007284927B2

(12) United States Patent
Kageyama

(10) Patent No.: US 7,284,927 B2
(45) Date of Patent: Oct. 23, 2007

(54) WRITING INSTRUMENT INCLUDING STICK-SHAPED MATERIAL PROPELLING MECHANISM

(75) Inventor: Hidehei Kageyama, Kawagoe (JP)

(73) Assignee: Kotobuki & Co., Ltd., Kawagoe-Shi, Saitama-Ken (JP)

( * ) Notice: Subject to any disclaimer, the term of this patent is extended or adjusted under 35 U.S.C. 154(b) by 68 days.

(21) Appl. No.: 11/165,327

(22) Filed: Jun. 24, 2005

(65) Prior Publication Data

US 2006/0291947 A1 Dec. 28, 2006

(51) Int. Cl.
*B43K 21/22* (2006.01)
*B43K 27/07* (2006.01)
*B43K 27/00* (2006.01)

(52) U.S. Cl. ..... 401/93; 401/92; 401/31; 401/19

(58) Field of Classification Search ..... 401/17–19, 401/29–33, 52, 92–94, 258–260
See application file for complete search history.

(56) References Cited

U.S. PATENT DOCUMENTS 3,072,101 A * 1/1963 Kovacs ..... 401/52
5,662,425 A * 9/1997 Mitsuya ..... 401/68
6,254,295 B1 * 7/2001 Cheng ..... 401/30

FOREIGN PATENT DOCUMENTS

JP 4-25499 1/1992
JP 5-45513 11/1993

* cited by examiner

*Primary Examiner*—David J. Walczak
(74) *Attorney, Agent, or Firm*—McGinn IP Law Group, PLLC

(57) ABSTRACT

A writing instrument including a stick-shaped material propelling mechanism which is capable of propelling a stick-shaped material without relatively rotating the stick-shaped material with a small number of components is provided.

The writing instrument includes an outer barrel, a lead feeding mechanism disposed in the outer barrel, and a stick-shaped material propelling mechanism connected to a rear portion of the lead feeding mechanism, a female thread is formed on an inner peripheral surface of a rear portion of a lead tank of the lead feeding mechanism. The stick-shaped material propelling mechanism includes a knock cap connected to the lead feeding mechanism to be relatively rotatable, and a stick-shaped material bearer which is slidable and unrotatable relative to the knock cap and for holding a stick-shaped material, and a male thread which is screwed into the female thread of the lead tank is integrally formed at the stick-shaped bearer.

13 Claims, 6 Drawing Sheets

WRITING INSTRUMENT INCLUDING STICK-SHAPED MATERIAL PROPELLING MECHANISM

BACKGROUND OF THE INVENTION

1. Field of the Invention

The present invention relates to a writing instrument including a stick-shaped material propelling mechanism.

2. Description of the Related Art

Conventionally, as this kind of writing instrument, for example, the ones described in Japanese Utility Model Publication No. 5-45513 and in Japanese Patent Laid-Open No. 4-25499 are known.

In a propelling pencil described In Japanese Utility model Publication No. 5-45513, a writing shaft body is disposed in an outer barrel, a spiral groove is provided in an inner surface of a rear part of a cylindrical cap, and a rear portion of a cylindrical body is attached to the cylindrical cap so as to be relatively rotatable, a slit is provided at a rear portion of the cylindrical body, an eraser bearer is slidably fitted into the slit, a projection provided at the eraser bearer is screwed into the spiral groove, and a front portion of the cylindrical body is attachable and detachable to and from the outer barrel, relatively unrotatable and movable in an axial direction.

In the propelling pencil described in Japanese Patent Laid-Open No. 4-25499, a writing body is disposed in an outer barrel, a projection is formed on an inner peripheral surface of a rear end of a lead tank of the writing body, a long groove which is engaged with the projection and a threaded groove are formed on a holder as an eraser bearing, a thread projection mated with the threaded groove of the holder is formed on an inner peripheral surface of a rotary sleeve, and the rotary sleeve is mounted on a rear end portion of the lead tank so as to be relatively rotatable.

In each of the above documents, the eraser held by the eraser bearer is capable of projecting and retracting from the rear end of the rear barrel by relative rotation between the outer barrel and the rear barrel.

However, in the former document, the number of components is large, and in both the documents, the eraser bearer and the rear barrel are screwed in each other, and the eraser held in the eraser bearer is propelled while relatively rotating with respect to the rear barrel, and therefore, there arises the problem that a distance along which the eraser slides in contact with the inner peripheral surface of the rear barrel is long with respect to the propelling amount of the eraser, and therefore, the operation efficiency is low.

SUMMARY OF THE INVENTION

In view of the foregoing and other drawbacks, disadvantages and problems of the conventional structures, an object of the present invention is to provide a writing instrument including a stick-shaped material propelling mechanism capable of propelling a stick-shaped material with a small number of components without making the stick-shaped material rotate relatively with respect to a rear barrel.

In order to achieve the above-described object, the invention according the present invention is in a writing instrument including an outer barrel, a writing shaft body disposed In the outer barrel, and a stick-shaped material propelling mechanism connected to a rear portion of the writing shaft body, characterized in that the writing shaft body has a part on which a female thread is formed on an inner peripheral surface, and the part is incapable of relatively rotating with the outer barrel, and the stick-shaped material propelling mechanism includes a rear barrel connected to the writing shaft body to be relatively rotatable, and a stick-shaped material bearer which is relatively unrotatable and slidable in an axial direction in the rear barrel and holds a stick-shaped material, and a male thread which is screwed into the female thread of the writing shaft body is integrally formed on the stick-shaped material bearer.

The stick-shaped bearer can include a holding part which holds the stick-shaped material, and the holding part can be slidably fitted in a longitudinal groove formed in an inner peripheral surface of the rear barrel.

A part where the male thread is not formed can be provided at a tip end portion of the stick-shaped material bearer, and a slit can be formed in the part where the male thread is not formed.

A center hole which communicates with a center hole of the writing shaft body can be formed in the stick-shaped material bearer to penetrate through the stick-shaped material bearer.

Preferably, a lead is capable of being inserted from a rear side by removing the stick-shaped material from the stick-shaped material bearer.

According to the present invention, on performing an operation of propelling the stick-shaped material, the rear barrel is rotated with respect to the outer barrel, and thereby, relative rotation occurs between the stick-shaped material bearer incapable of relatively rotating with respect to the rear barrel and the writing shaft body incapable of relatively rotating with respect to the outer barrel. The male thread of the stick-shaped bearer is guided by the female thread of the writing shaft body, and the stick-shaped material bearer moves in the axial direction in the rear barrel, therefore, propelling the stick-shaped material. Since the stick-shaped material bearer and the rear barrel are incapable of relatively rotating, the stick-shaped material does not rotate relatively with the rear barrel, and is linearly propelled with respect to the rear barrel. Thereby, the operation efficiency can be made favorable. Further, the writing instrument can be constructed by the small number of components.

DETAILED DESCRIPTION OF THE PREFERRED EMBODIMENTS

Figure 1:
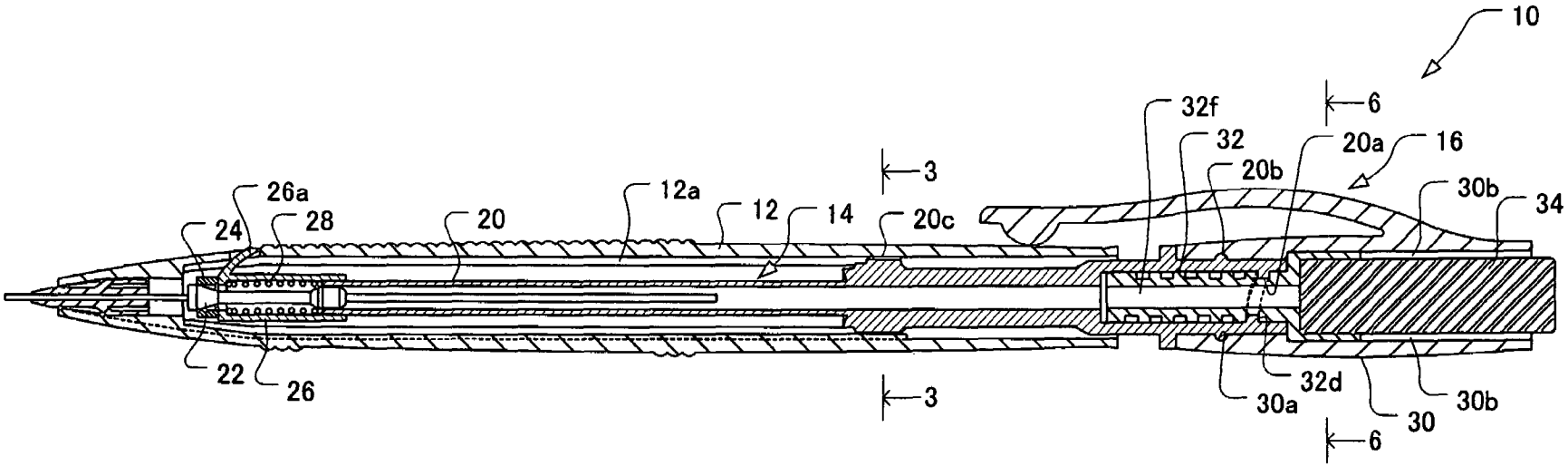
FIG. 1 is an overall longitudinal sectional view of a propelling pencil according to an embodiment of the present invention.

Preferred embodiments of the present invention will be described in detail below with reference to the accompanying drawings.

In the drawings, reference numeral 10 denotes a propelling pencil as a writing instrument, and the propelling pencil 10 generally includes an outer barrel 12, a lead feeding mechanism 14 that is a writing shaft body which feeds lead disposed in the outer barrel 12, a stick-shaped material propelling mechanism 16 which is connected to a rear part of the lead feeding mechanism 14 and disposed behind the outer barrel 12.

The outer barrel 12 is an integrally molded product it the example shown in the drawings, but it is possible to construct the outer barrel by a plurality of members.

The lead feeding mechanism 14 is disposed in the outer barrel 12. The lead feeding mechanism 14 includes a lead tank 20 housing leads, a chuck 22 which is fixed to a tip end of the lead tank 20 to clamp and feed a lead, a chuck ring 24 which is arranged on an outer peripheral side of the chuck 22 to clamp the chuck 22, a sleeve 26 for restricting retreat of the chuck ring 24, and a return spring 28 interposed between a front end of the sleeve 26 and a front end of the lead tank 20. The sleeve 26 has an engaging piece 26*a* which is engaged with an opening formed in the outer barrel 12 so that the sleeve 26 is fixed to the outer barrel 12. The return spring 28 urges the lead tank 20 and the chuck 22 fixed to the lead tank 20 rearwardly.

Figure 2:
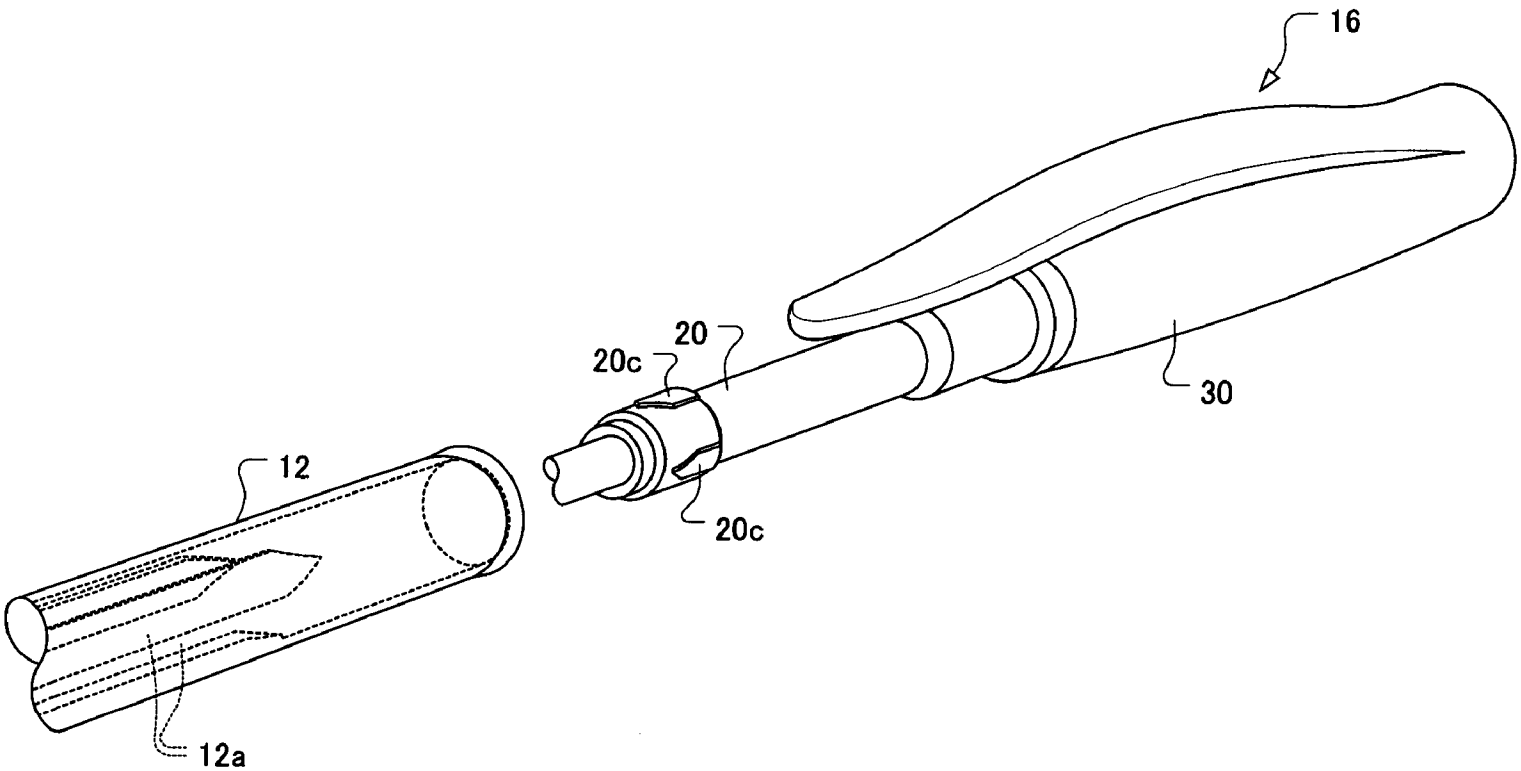
FIG. 2 is an exploded perspective view showing relationship between a lead tank and a stick-shaped material propelling mechanism, and an outer barrel.
Figure 3:
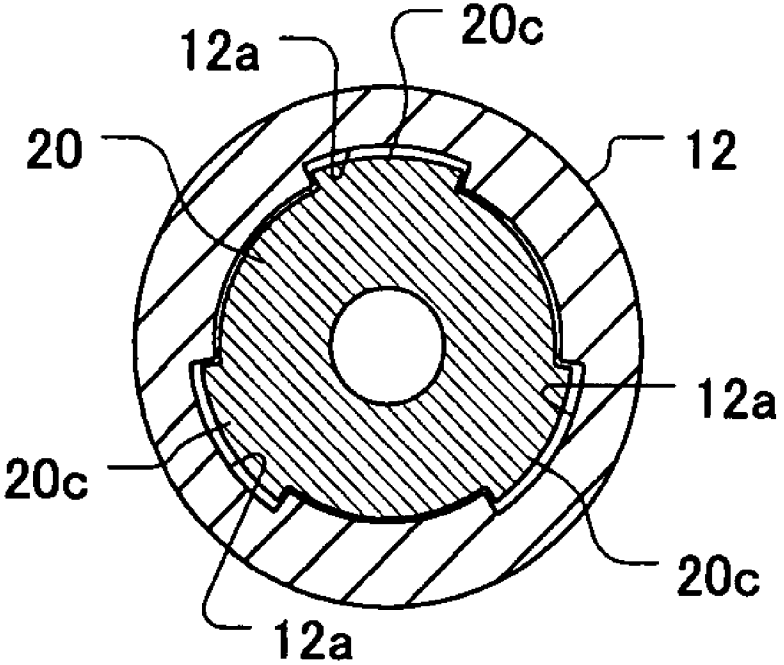
FIG. 3 is a sectional view taken along 3-3 line in FIG. 1.

As shown in FIG. 2 and FIG. 3, a plurality of projected parts 20*c* which project in an outer diameter direction are formed to be spaced in the circumferential direction on the outer peripheral surface of the lead tank 20, and each of the projected part 20*c* is slidably fitted in a longitudinal groove 12*a* formed on an inner peripheral surface of the outer barrel 12. This makes the lead tank 20 and the outer barrel 12 relatively unrotatable but slidable in an axial direction. The present invention is not limited to the construction of the projected part 20*c* and the longitudinal groove 12*a* to make the lead tank 20 unrotatable relative to the outer barrel 12, but a longitudinal rib may be provided on the inner peripheral surface of the outer barrel 12 and a longitudinal groove may be provided on the outer peripheral surface of the lead tank 20, or the inner peripheral surface of the outer barrel 12 and the outer peripheral surface of the lead tank 20 may be formed in polygonal shapes which are fitted to each other.

Figure 4:
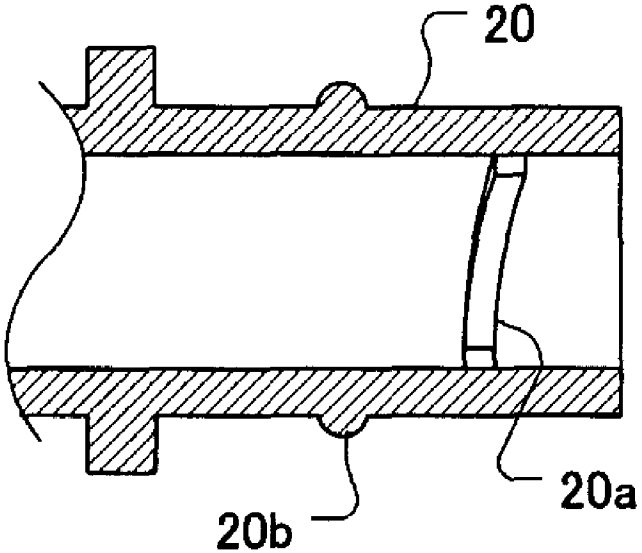
FIG. 4 Is a longitudinal sectional view of a rear end portion of the lead tank.

Further, as shown in FIG. 4, a spiral short protruding ridge is formed on an inner peripheral surface of a rear end portion of the lead tank 20, and the protruding ridge is a female thread 20*a*.

As shown in FIG. 1, the stick-shaped material propelling mechanism 16 includes a knock cap 30 as a rear barrel, and a stick-shaped material bearer 32 which holds an eraser 34 as a stick-shaped material. The knock cap 30 has an annular recessed part 30*a* which engages with an annular projection 20*b* formed on the outer peripheral surface of the rear end portion of the lead tank 20, and thereby, the knock cap 30 is connected to the rear portion of the lead tank 20 to be relatively rotatable and unmovable in the axial direction. A tip end of the knock cap 30 may be positioned rearward of the rear end of the outer barrel 12 as shown in the drawing, but the present invention is not limited to this, and the tip end of the knock cap 30 can be positioned forward of the rear end of the outer barrel 12, namely, the knock cap 30 can cap and envelop the rear end portion of the outer barrel 12, or the knock cap 30 can insert into the rear end portion of the outer barrel 12.

Figure 6:
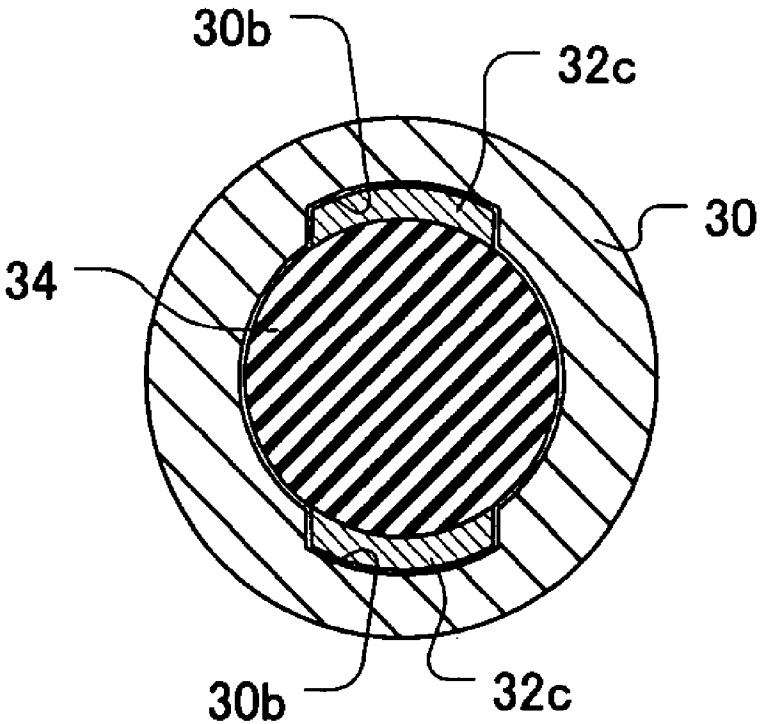
FIG. 6 in a sectional view taken along 6-6 line in FIG. 1 (note that a clip is omitted).

A pair of longitudinal grooves 30*b* and 30*b* extending in the axial direction are formed on the inner peripheral surface of the rear portion of the knock cap 30 (see FIG. 6).

Figure 5:
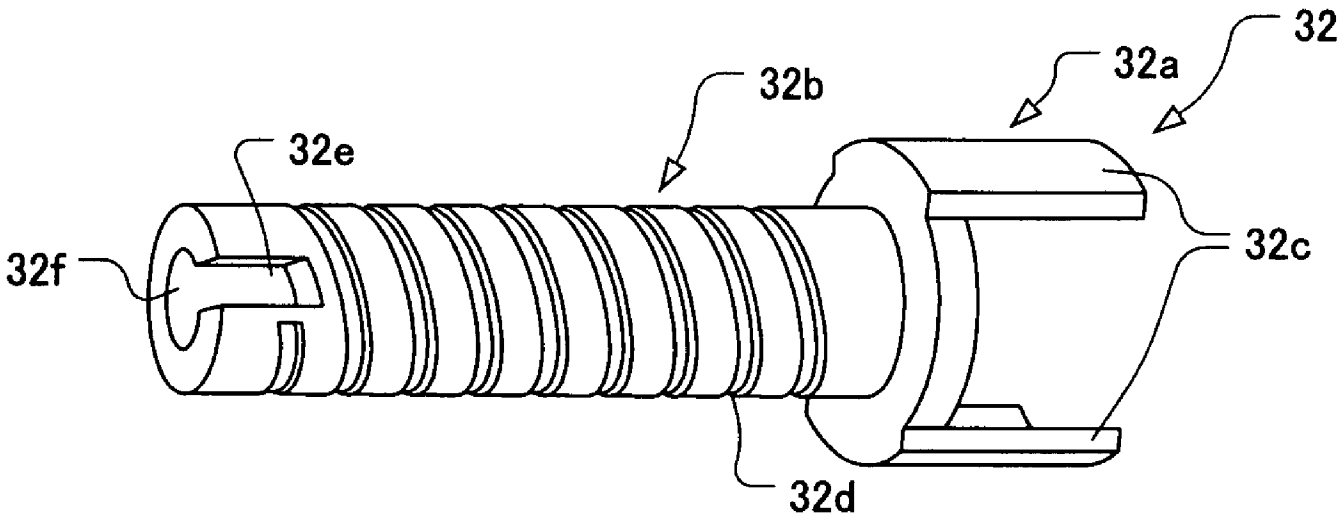
FIG. 5 is a perspective view of a stick-shaped material bearer.

The stick-shaped material bearer 32 includes a holding part 32*a* for holding the eraser 34 and a male threaded shaft 32*b* extending forward from the holding part 32*a* as shown in FIG. 5. The holding part 32*a* is constructed by a pair of sandwiching pieces 32*c* and 32*c* which sandwiches the eraser 34 between them, and the sandwiching piece 32*c* is fitted in the longitudinal grove 30*b* of the knock cap 30 slidably in the axial direction. A male thread 32*d* of the male threaded shaft 32*b* Is screwed into the female thread 20*a* of the lead tank 20.

A slit 32*e* extending in the axial direction is formed substantially in a range where the male thread 32*d* does not exit at the tip end portion of the male threaded shaft 32*b*. The number of slits 32*e* is one in the example in the drawing, but the number of slits is not limited to this, and two or more slits can be provided. When the male threaded shaft 32*b* of the stick-shaped material bearer 32 is inserted into the rear end portion of the lead tank 20 to connect the stick-shaped material propelling mechanism 16 to the lead tank 20 at the time of assembly, the resiliency of the slit 32*e* allows the tip end portion of the male threaded shaft 32*b* to pass the female thread 20*a* of the lead tank 20 so that the male thread shaft 32*b* can be easily attached into the rear end portion of the lead tank 20. The portion of the male threaded shaft 32*b*, where the male thread 32*d* does not exist, acts as a stopper for preventing the stick-shaped material bearer 32 from falling-off from the lead tank 20.

A center hole 32*f* penetrates through the male threaded shaft 32*b* In the axial direction, and the center hole 32*f* communicates with a part of the holding part 32*a*, which holds the eraser 34, and also communicates with a center hole of the lead tank 20.

In the propelling pencil 10 constructed as above, on performing an operation of propelling the eraser 34, the knock cap 30 is rotated with respect to the outer barrel 12, and thereby, relative rotation occurs between the stick-shaped material bearer 32 incapable of relatively rotating with respect to the knock cap 30 and the lead tank 20 incapable of relatively rotating with respect to the outer barrel 12. The male thread 32*d* of the stick-shaped material bearer 32 is guided by the female thread 20*a* of the lead tank 20, and the stick-shaped material bearer 32 moves in the axial direction in the knock cap 30 therefore propelling the eraser 34. Since the stick-shaped material bearer 32 and the knock cap 30 are incapable of relatively rotating, the eraser 34 does not rotate relatively with the knock cap 30, and is linearly fed out with respect to the knock cap 30. Thereby, the operation efficiency can be made favorable.

When the operation of feeding a lead is performed, the knock cap 30 is knocked with respect to the outer barrel 12, whereby the lead tank 20 connected to the knock cap 30 moves forward and the lead is fed out.

When the operation of refilling leads is performed, the center hole 32*f* of the stick-shaped material bearer 32 communicates with the lead tank 20 by removing the eraser 34 from the stick-shaped material bearer 32, and therefore, the leads can be refilled into the lead tank 20 through the center of the stick-shaped material bearer 32. In order to facilitate attachment and detachment of the eraser 34 and the stick-shaped material bearer 32 to and from each other, it is preferable that the holding force for the eraser 34 of the holding part 32*a* of the stick-shaped material bearer 32 is not too strong. A weak holding force does not matter because a load applied on the eraser 34 from the knock cap 30 when the eraser 34 is fed is small.

Thus, in the above described embodiment, the propelling pencil is constructed by the small number of components, and thereby, the propelling pencils can be manufactured at low cost. However, in the above described embodiment, the components which are constructed by single members can be constructed by a plurality of components, and conversely, the components which are constructed by a plurality of components can be constructed by single components.

The above described embodiment is described with the propelling pencil as an example, but the embodiment is not limited to this, and it is possible to apply the present invention to any writing instruments such as a ball point pen and the like. The stick-shaped material is not limited to an eraser, but can be any stick-shaped materials such as a writing lead, an erasure stick, a fluorescent lead and the like.

While the principles of the invention have been described above in connection with specific embodiments, and particular modifications thereof, it is to be clearly understood that this description is made only by way of example and not as a limitation on the scope of invention.

What is claimed is:

1. A writing instrument comprising:

an outer barrel;

a lead feeding mechanism disposed in the outer barrel for feeding lead from a front end of the outer barrel, said lead feeding mechanism comprising:

a lead tank for housing leads, which is formed with a female thread on an inner peripheral surface thereof, said lead tank being incapable of rotating relative to the outer barrel; and a lead chuck fixed to a tip end of said lead tank for clamping and feeding a lead;

a stick-shaped material propelling mechanism connected to a rear portion of the lead feeding mechanism, said stick-shaped material propelling mechanism comprising:

a rear barrel rotatably connected to said lead tank of the lead feeding mechanism; and a stick-shaped material bearer for holding a stick-shaped material, the stick-shaped material bearer being unrotatable and slidable in an axial direction relative to the rear barrel, and integrally formed with a male thread which is screwed into the female thread of the lead tank of the lead feeding mechanism.

2. The writing instrument including a stick-shaped propelling mechanism according to claim 1, wherein said stick-shaped material bearer includes a holding part adapted to hold the stick-shaped material, and the holding part is slidably fitted in a longitudinal groove formed in an inner peripheral surface of the rear barrel.

3. The writing instrument including a stick-shaped propelling mechanism according to claim 1, wherein a part where the male thread is not formed is provided at a tip end portion of the stick-shaped material bearer, and a slit is formed in the part where the male thread is not formed.

4. The writing instrument including a stick-shaped propelling mechanism according to claim 1, wherein a center hole which communicates with a center hole of the lead tank is formed in said stick-shaped material bearer.

5. The writing instrument including a stick-shaped propelling mechanism according to claim 1, wherein a lead is capable of being inserted from a rear side by removing the stick-shaped material from the stick-shaped material bearer adapted to hold the stick-shaped material.

6. The writing instrument including a stick-shaped propelling mechanism according to claim 1, wherein the lead tank comprises a plurality of projected parts that project in an outer diameter direction.

7. The writing instrument including a stick-shaped propelling mechanism according to claim 6, wherein the projected parts are spaced apart from one another in a circumferential direction on an outer peripheral surface of the lead tank.

8. The writing instrument including a stick-shaped propelling mechanism according to claim 7, wherein the outer barrel engages with at least one of the plurality of projected parts on the outer peripheral surface of the lead tank.

9. The writing instrument including a stick-shaped propelling mechanism according to claim 6, wherein the projected parts are slidably fitted in a longitudinal groove formed in an inner peripheral surface of the outer barrel.

10. The writing instrument including a stick-shaped propelling mechanism according to claim 1, wherein the rear barrel has an annular recessed part.

11. The writing instrument including a stick-shaped propelling mechanism according to claim 10, wherein the lead tank includes an annular projection engaged with said annular recessed pan of the rear barrel so that the rear barrel is connected to the lead tank to be relatively rotatable and immovable in an axial direction.

12. The writing instrument including a stick-shaped propelling mechanism according to claim 11, wherein the rear barrel and the lead tank are movable in an axial direction to the outer barrel.

13. The writing instrument including a stick-shaped propelling mechanism according to claim 1, wherein the rear barrel is rearwardly spaced apart from the outer barrel so as to allow a relative movement between the rear barrel and the outer barrel to activate the lead feeding mechanism.

* * * * *